United States Patent [19]

Swope, Jr.

[11] Patent Number: 4,580,588

[45] Date of Patent: Apr. 8, 1986

[54] TOOTH CARE UNIT

[76] Inventor: Virgil R. Swope, Jr., 6910 Stoneman Dr., North Highlands, Calif. 95660

[21] Appl. No.: 503,912

[22] Filed: Jun. 13, 1983

[51] Int. Cl.[4] ..... A45D 44/18

[52] U.S. Cl. ..... 132/84 B; 401/125

[58] Field of Search ..... 132/84 R; 15/167 R, 15/172; 401/125

[56] References Cited

U.S. PATENT DOCUMENTS

| | | | |
|---|---|---|---|
| 3,372,426 | 3/1968 | Schwartzman | 132/84 R |
| 3,864,047 | 2/1975 | Shorrod | 132/84 R |
| 4,388,011 | 6/1983 | Smith | 132/84 R |
| 4,403,623 | 9/1983 | Mark | 132/84 R |
| 4,472,853 | 9/1984 | Rauch | 132/84 R |

*Primary Examiner*—Gregory E. McNeill

*Attorney, Agent, or Firm*—Lothrop & West

[57] ABSTRACT

For use with a toothpaste tube having a conical end face surrounding an exteriorly threaded nipple there is a rigid stem long enough to be grasped by a user. A hub on the stem is interiorly threaded to engage the tube threads. A bristle base having bristles therein is removably engageable with the stem. The bristle base, the stem and the hub have a connecting interior passageway to conduct toothpaste from the tube when squeezed to the bristle base. The toothpaste tube and the stem serve for manipulation of the bristles.

3 Claims, 10 Drawing Figures

FIG-2
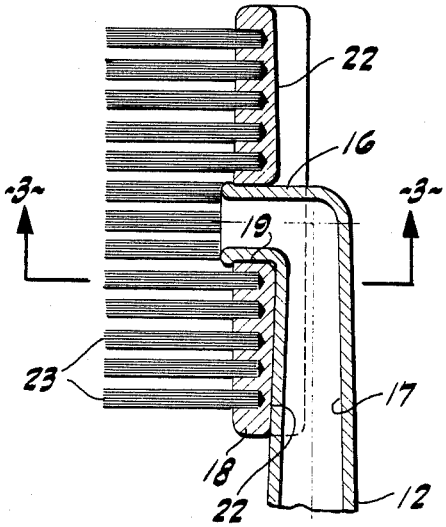
FIG-1
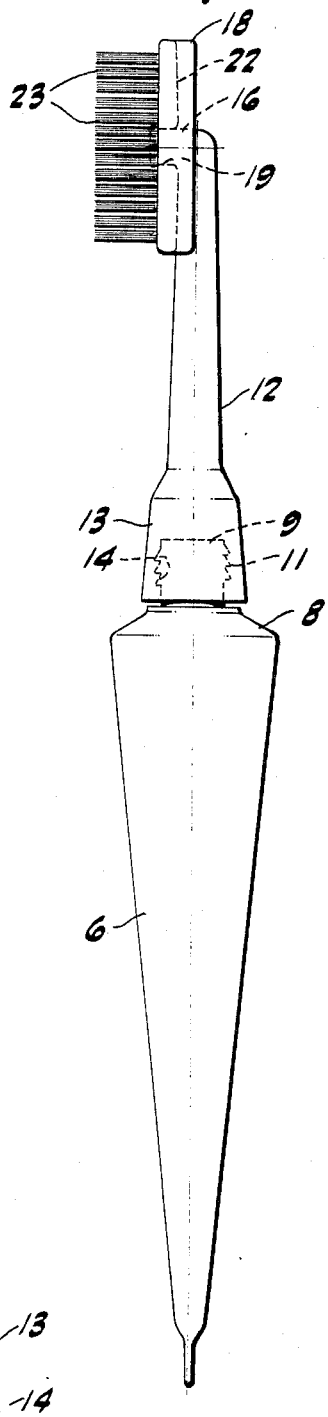
FIG-3
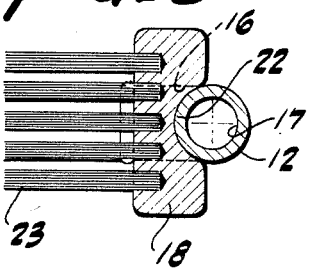
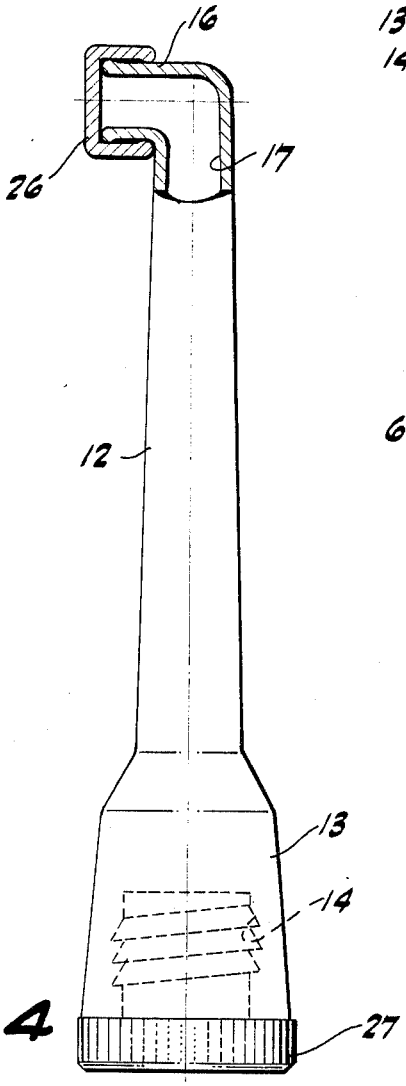
FIG-4
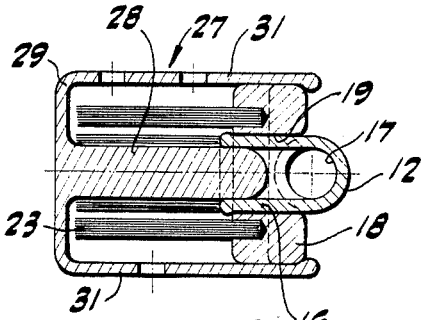
FIG-5

FIG-8
FIG-7
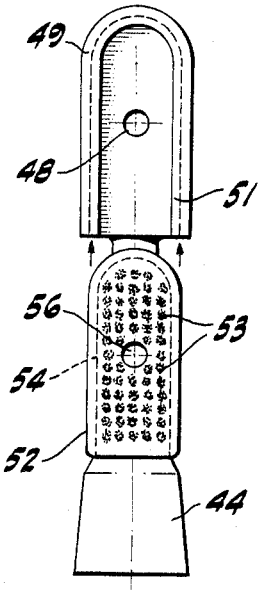
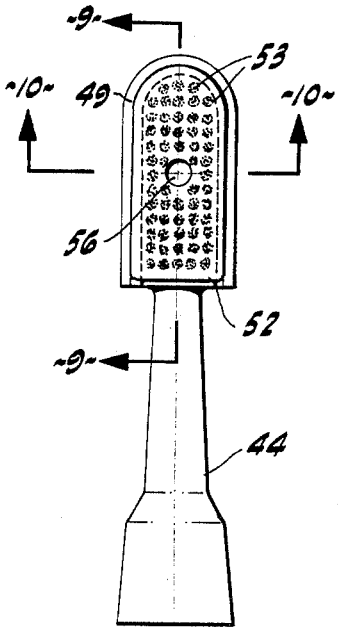
FIG-6
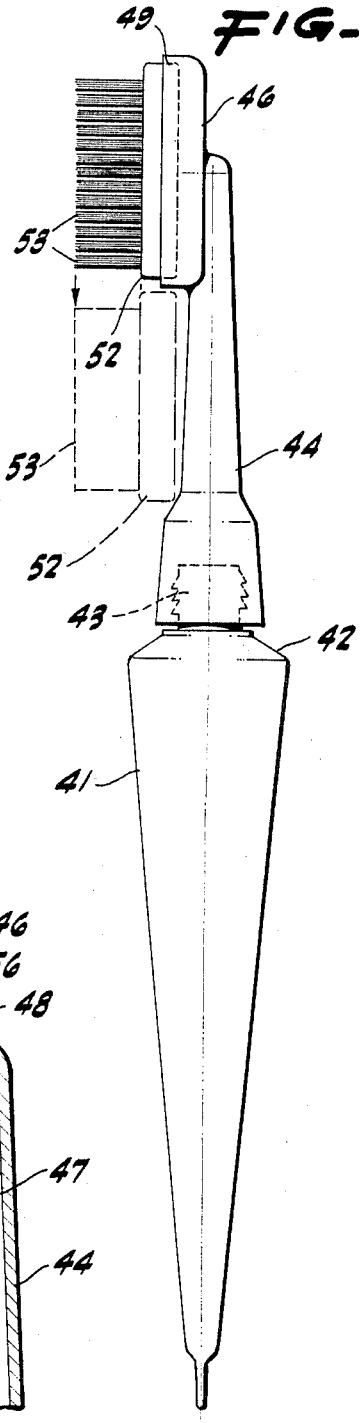
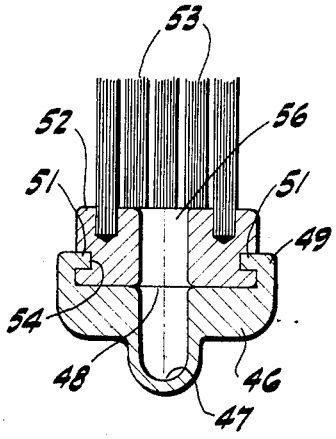
FIG-10
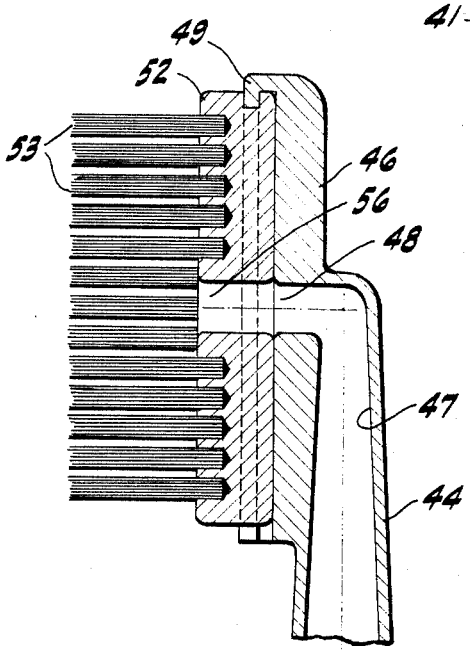
FIG-9

TOOTH CARE UNIT

BRIEF SUMMARY OF THE INVENTION

Attached to a standard toothpaste tube there is a graspable, hollow stem removably engaged with a ported bristle block.

PRIOR ART OF INTEREST

Reference is made to U.S. Pat. No. 1,764,130 of June 17, 1930 to Vardeman, and U.S. Pat. No. 3,653,778 of Apr. 4, 1972 to Freiling. While these two patents have various features some of which are similar to some features of the present disclosure, they do not meet the terms of this complete disclosure nor the presently submitted claims.

BRIEF DESCRIPTION OF THE SEVERAL VIEWS OF THE DRAWINGS

FIG. 1 is a side elevation of one version of the tooth care unit pursuant to the invention.

FIG. 2 is a longitudinal, vertical cross-section through the brush region of the device.

FIG. 3 is a cross-section, the plane of which is indicated by the line 3—3 of FIG. 2.

FIG. 4 is a side elevation, partly in section, showing removable caps in position.

FIG. 5 is a cross-section showing a cover for use over the brush section.

FIG. 6 is a side elevation of a modified form of device.

FIG. 7 is a plan of a partially assembled structure as in FIG. 6.

FIG. 8 is an assembled view of the FIG. 7 structures.

FIG. 9 is a cross-section comparable to FIG. 2 but showing the modified form of device, the section being indicated by the lines 9—9 of FIG. 8.

FIG. 10 is a cross-section, as indicated by the lines 10—10 of FIG. 9.

DETAILED DESCRIPTION

There are many instances in which an improved arrangement for brushing teeth is highly desirable. One of these is for ready use by travelers, and another is for ready use by people somewhat handicapped, perhaps unable to see or unable well to coordinate manually. There is also a general field for an improved unit for use in dental hygiene.

In order to meet some of these and other requirements, there is provided an arrangement as shown in FIG. 1 in which there is included a standard toothpaste tube 6. This is made of the customary pliable metal or plastic envelope sealed at one end 7 and having a generally circular or conical face 8 at the other end surrounding a projecting, externally threaded nipple 9.

For particular use with the toothpaste tube so formed there is afforded a rigid, elongated stem 12 conveniently fabricated of a light, inexpensive plastic. The stem has a hub 13 containing a number of interior, female threads 14 adapted to interengage with the external threads 11. The stem 12 is of sufficient diameter and length so as to be readily grasped. It is of a convenient, cross-sectional contour; for example, circular, and extends to a laterally or outwardly projecting, cylindrical boss 16. There is an interior passageway 17 formed from one end to the other through the stem so that toothpaste ejected from the tube can travel entirely through the stem and emerge from the central portion of the boss.

Designed to engage with the stem is a plate 18 conveniently rectangular in plan and having a central opening 19 therethrough interengageable with the upstanding boss. These parts are preferably fabricated so that while they are detachable there is nevertheless sufficient friction present for any ordinary tooth uses. If desired, the plate 18 may be made of slightly springy material and the boss 16 may have a slightly enlarged end. In any case, the plate as a separate member can be pushed over or snapped onto the boss.

It is preferred that the rectangular plate have its longitudinal orientation substantially the same as that of the stem 12. For that reason the plate, along its under side or the side next to the stem, has a groove 22 or depression adapted to fit against the stem. With this arrangement the plate is not able to rotate about the boss but is held in a relatively fixed position.

The base 18 is provided with upstanding bristles 23 of the customary sort. The bristles are arranged or distributed on the plate in such a fashion as to allow some central, free area in the vicinity of the opening 19 so that toothpaste extruded from the boss can rise upwardly between the adjacent bristles and can spread laterally and longitudinally as the bristles are deflected in use.

The use of this structure is simple and can be accomplished readily even by handicapped or visually deprived people. For example, after removal of the customary cap usually furnished with the toothpaste tube 6, the cap can be replaced by the stem 12. This is screwed on and tightened sufficiently so that the shoulder on the stem abuts the conical surface of the tube and forms a tight seal. The stem already has been or then is provided with a plate and bristle structure and the device is ready for use. The user simply employs the tube 6 and the stem 12 as a handle in effectuating the usual motions for brushing his teeth.

When the supply of toothpaste is exhausted from the tube 6, the tube is readily unscrewed and a new one can be substituted in its place to continue the advancement and ejection of the toothpaste already in the stem and making it available for use.

If desired, although not essential, the plate 18 can be detached at any time simply by lifting it off of the stem 12. The then-exposed end of the stem can be protected by a cap 26 (FIG. 4). This is readily snapped into position and is easily snapped off, alternating with the plate 18 in use. Various different plates 18, with various different bristle configurations and stiffnesses, can easily be employed, as well.

In order to seal the opening into the stem 12 and also to leave the plate and bristles in place, there can be provided a cover 27, as shown in FIG. 5, in which a central rod 28 is frictionally receivable within the boss, and a vented cover 29 and sides 31 are disposed to encompass the various bristles and to overlie the margins of the subjacent plate 18.

In another version of the device, there is provided a standard toothpaste tube 41, as before, having a generally conical, exposed end face 42 with an externally threaded nipple 43. Onto the nipple there is screwed an internally threaded stem 44 merging with an integral plate 46. There is a passageway 47 registering with the opening in the nipple 43 and continuing entirely through the stem and turning to emerge in an opening 48 at the top thereof. The stem 44 preferably terminates within a hollow block 49 having longitudinal flanges 51 on its sides. A plate 52 carrying bristles 53 and having longitudinal grooves 54 therein is longitudinally slid into position in interengagement with the inturned flanges on the block 49.

An opening 56 through the plate affords access to the interior of the hollow block 49. When the tube of toothpaste 41 is squeezed, the contents are ejected along the passageway 47 and through the hollow block 49 and outwardly through the opening 48 into positions of use with the bristles. The general manner of use of this structure is substantially the same as previously described.

I claim:

1. A tooth care unit for use with a toothpaste tube having a substantially conical end face surrounding an outer nipple having an exterior thread comprising a rigid, elongated stem of a size readily grasped by a user; a hub on said stem having an interior thread therein adapted to engage said exterior thread; an end shoulder on said stem adapted to abut said end face; a circular-cylindrical hollow boss on said stem and extending laterally therefrom; means defining a circular passageway open at both ends and extending continuously through said hub, said stem and said boss; a plate having an opening therethrough adapted to be journalled on the exterior of said boss for rotation around said boss and relative to said stem; bristles upstanding from said plate; and means defining a radial groove in said plate adapted partially to receive said stem to inhibit free rotation of said plate around said boss.

2. A tooth care unit for use with a toothpaste tube having a substantially conical end face surrounding an outlet nipple having an exterior thread comprising a rigid, elongated stem of a size readily grasped by a user; a hub on said stem having an interior thread thereon adapted to engage said exterior thread; an end shoulder on said stem adapted to engage said end face; means on said stem on the exterior providing a journal and on the interior having a central hollow; means defining a continuous passageway open at both ends and extending through said hub and said stem and into said central hollow; a bristle block having a central opening therethrough adapted to turn on and communicate with said central hollow; and means on said bristle block defining lateral grooves therein adapted to engage said stem as a detent.

3. A tooth care unit for use with a toothpaste tube having a substantially conical end face surrounding an outer nipple having an exterior thread comprising a rigid, elongated stem of a size readily grasped by a user; a hub on said stem having an interior thread thereon adapted to engage said exterior thread; an end shoulder on said stem adapted to abut said end face; a bristle block having two opposite sides; bristles in said block and projecting from one of said sides thereof; means defining a transverse opening entirely through said bristle block between said two sides thereof; hollow cylindrical means extending transversely from said stem and through said transverse opening between the opposite sides of said bristle block to provide a journal engagement between said block and said stem; means for providing a detent engagement between said bristle block and said stem; and means in said stem for conducting toothpaste from said nipple to and through said hollow means to said bristle block.

* * * * *